US005277122A

United States Patent [19]

Almaraz et al.

[11] Patent Number: 5,277,122

[45] Date of Patent: Jan. 11, 1994

[54] DUAL HEAD ANCHOR ADJUSTER

[75] Inventors: Roberto Almaraz; David Gustin; Ronald L. Rhodes; Robert L. Turner, all of Racine, Wis.

[73] Assignee: Racine Railroad Products, Inc., Racine, Wis.

[21] Appl. No.: 887,558

[22] Filed: May 18, 1992

Related U.S. Application Data

[63] Continuation of Ser. No. 573,496, Aug. 27, 1990, abandoned.

[51] Int. Cl.[5] ..... E01B 29/00

[52] U.S. Cl. ..... 104/17.2

[58] Field of Search ..... 104/17.2, 12, 2, 307

[56] References Cited

U.S. PATENT DOCUMENTS

| | | | |
|---|---|---|---|
| 3,117,530 | 1/1964 | Miller | 104/17.2 |
| 3,117,531 | 1/1964 | Miller | 104/17.2 |
| 3,272,148 | 9/1966 | McIlrath | 104/17.2 |
| 3,438,335 | 4/1969 | McIlrath | 104/17.2 |
| 4,068,593 | 1/1978 | Leeves | 104/17.2 |
| 4,494,463 | 1/1985 | Young et al. | 104/17.2 |
| 4,890,558 | 1/1990 | Quella et al. | 104/17.2 |
| 4,942,821 | 7/1990 | Rossanigo | 104/12 |

FOREIGN PATENT DOCUMENTS

| | | | |
|---|---|---|---|
| 0793036 | 8/1968 | Canada | 104/17.2 |
| 2031486 | 4/1980 | United Kingdom | 104/17.2 |

OTHER PUBLICATIONS

Holley Engineering brochure entitled "Anchor Squeezer", 2 pages, no date.

*Primary Examiner*—Mark T. Le

*Attorney, Agent, or Firm*—Wood, Phillips, VanSanten, Hoffman & Ertel

[57] ABSTRACT

A rail adjuster has a frame which mounts a head assembly for powered vertical movement between a raised travel position and a lowered operative position, with the head assembly having adjuster arms which can be positioned immediately adjacent a pair of rail-mounted anchors. The adjuster arms are moved together to shift the rail-mounted anchors along the rail toward the tie to achieve the anchor adjusting. The adjuster arms are constructed in a pivoting linkage having a horizontally acting hydraulic cylinder to provided a substantially horizontal force to the adjuster arms for providing an enhanced mechanical advantage in adjusting the anchors.

12 Claims, 5 Drawing Sheets

DUAL HEAD ANCHOR ADJUSTER

This application is a continuation of the U.S. patent application Ser. No. 573,496, filed on Aug. 27, 1990, now abandoned.

FIELD OF THE INVENTION

This invention generally relates to an anchor adjuster for adjusting rail-mounted anchors and, more particularly, to an apparatus for moving two pairs of rail-mounted anchors toward a tie while mounted to the rail.

BACKGROUND OF THE INVENTION

The object of the present invention is to provide an improved anchor adjuster for adjusting one or more rail-mounted anchors on a rail toward a tie.

A rail anchor clamps onto a railway rail and is positioned to abut a vertical face of a tie whereby resistance is provided against longitudinal movement of a rail relative to the supporting tie.

For many years, there have been machines for setting, applying and removing rail anchors. This procedure involves both placing rail-mounted anchors in close abutting relation with opposite vertical faces of a tie when installing the anchors and/or tie, as well as shifting the tie-abutting rail-mounted anchors lengthwise of the rail so that a tie remover can withdraw the tie longitudinally from beneath the rail to replace the tie. Equipment for spreading anchors is shown in Quella U.S. Pat. No. 4,890,558. The adjusting of anchors into tie-abutting positions generally can be accomplished with a limited degree of efficiency with the use of a rail anchor relocator, such as that shown in Miller U.S. Pat. No. 3,117,531.

Utilization of equipment of the type shown in Miller has proven effective for many years, but, however, is subject to some limitations. The relocator assembly in Miller is suspended from a chain during transport of the machine and is allowed to fall under the acceleration of gravity to an operative position. To sufficiently engage an anchor for relocating, it is necessary that the assembly be lowered to a position some distance below the base of the rail. The rocks and gravel which comprise railway ballast for rigidifying the ties is frequently very densely packed and prevents the necessary downward deployment of the assembly. When this type of ballast is encountered, the apparatus of Miller is inadequate to adjust the anchors.

Also, because of the minimal tolerances and tight fit of the anchors on the rails, substantial force is required to shift the anchors along the rails toward the tie. Miller discloses a pin-and-groove linkage arrangement which imparts minimal horizontal forces to the anchors during a portion of the stroke of a hydraulic driving cylinder. The resulting mechanical advantage requires a high-powered hydraulic actuator which inherently must provide non-linear adjusting force versus actuator stroke characteristics.

SUMMARY OF THE INVENTION

In the exemplary embodiment of the invention, a dual anchor adjuster is provided having a frame which mounts a head assembly for powered vertical movement between a raised travel position and a lowered operative position and with the head assembly having adjuster arms which can be positioned immediately adjacent a pair of rail-mounted anchors. The adjuster arms can be moved together to shift the rail-mounted anchors along the rail toward the tie to achieve anchor adjusting. The adjuster arms are embodied in a pivoting linkage having an interconnected hydraulic cylinder which provides a substantially horizontal force to the adjuster arms for establishing an enhanced mechanical advantage in adjusting the anchors.

Specifically, the anchor adjuster has a pair of arms each having oppositely spaced ends and pivotally connected to a head assembly at a point intermediate opposite arm ends, and an actuator interconnecting one opposite end of each arm for providing a substantially purely horizontal force to pivot the arms over a range of motion of the actuator. The actuator is a hydraulic cylinder having oppositely acting force imparting surfaces for providing oppositely directed substantially horizontal forces to pivot the adjuster arms.

The anchor adjuster has interchangeable travel limiting means on the frame for setting the lowered position of the head assembly due to variation in the height of a rail with which the anchor adjuster is used. Interchangeable adjuster tools of selectable width are provided on the adjuster arms for accommodating variations in the width of a rail with which the anchor adjuster is used.

The anchor adjuster has a hydraulic cylinder with a substantially vertically movable piston rod interposed between the frame and the head assembly for driving the head assembly vertically toward and away from the tie.

The invention further comprehends an anchor adjuster for adjusting one or more rail-mounted anchors on a pair of parallel spaced rails toward a tie at points along the length of the rails in the form of a vehicle movable along the rails with a frame overlying a portion of the rails.

A safety mechanism secures the head assembly in a fixed position during transport. The safety mechanism includes a first aperture on the frame and a second aperture on the head assembly, with the first aperture and the second aperture being in alignment when the head is raised. A locking pin is inserted into the two apertures and holds the head in its raised position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE INVENTION

Figure 1:
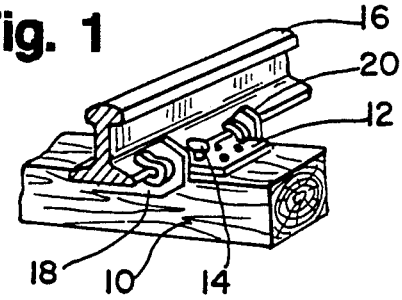
FIG. 1 is a fragmentary perspective view showing a rail, a tie and associated anchors.
Figure 4:
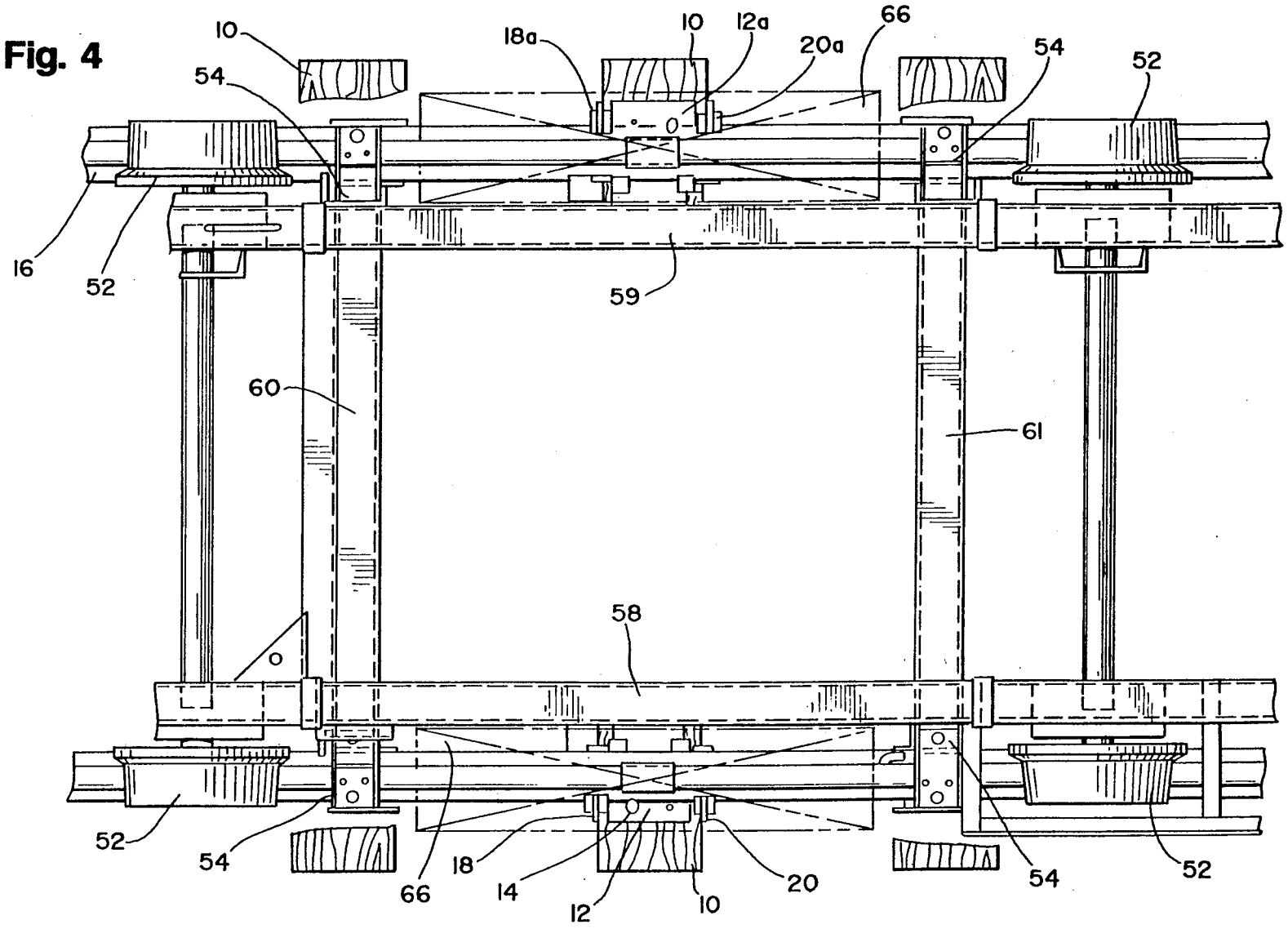
FIG. 4 is a fragmentary plan view of the vehicle frame structure shown in FIG. 3.

The present invention is used with railway track structure including a rail and a tie and associated structure including a tie plate and rail-mounted anchors. This is shown in FIG. 1, wherein a tie 10 has a tie plate 12 secured thereto by at least one rail spike 14. A rail 16 is mounted on the tie plate and a pair of rail-mounted anchors 18 and 20 abut opposite vertical faces of the tie. As seen in FIG. 4, there can be similar associated structure adjacent the opposite end of the tie including a tie plate 12*a* and rail anchors 18*a* and 20*a*. A series of ties 10 spaced lengthwise of the rail 16 each can have the structure as described in connection with FIG. 1. Ties 10 typically are embedded within a layer of ballast (not shown) comprising rocks and gravel to assist in stabilizing the ties. In order to sufficiently support the ties, ballast often is packed very densely to eliminate any clearance between a tie and the surrounding ballast.

Generally, the function of an anchor adjuster is to move the anchors from a spread position spaced from opposite sides of the tie into a tie-abutting position as shown in FIG. 4. This results in a firm clamping of the tie between the anchors for resisting longitudinal movement of the rail relative to the supporting tie.

Figure 2:
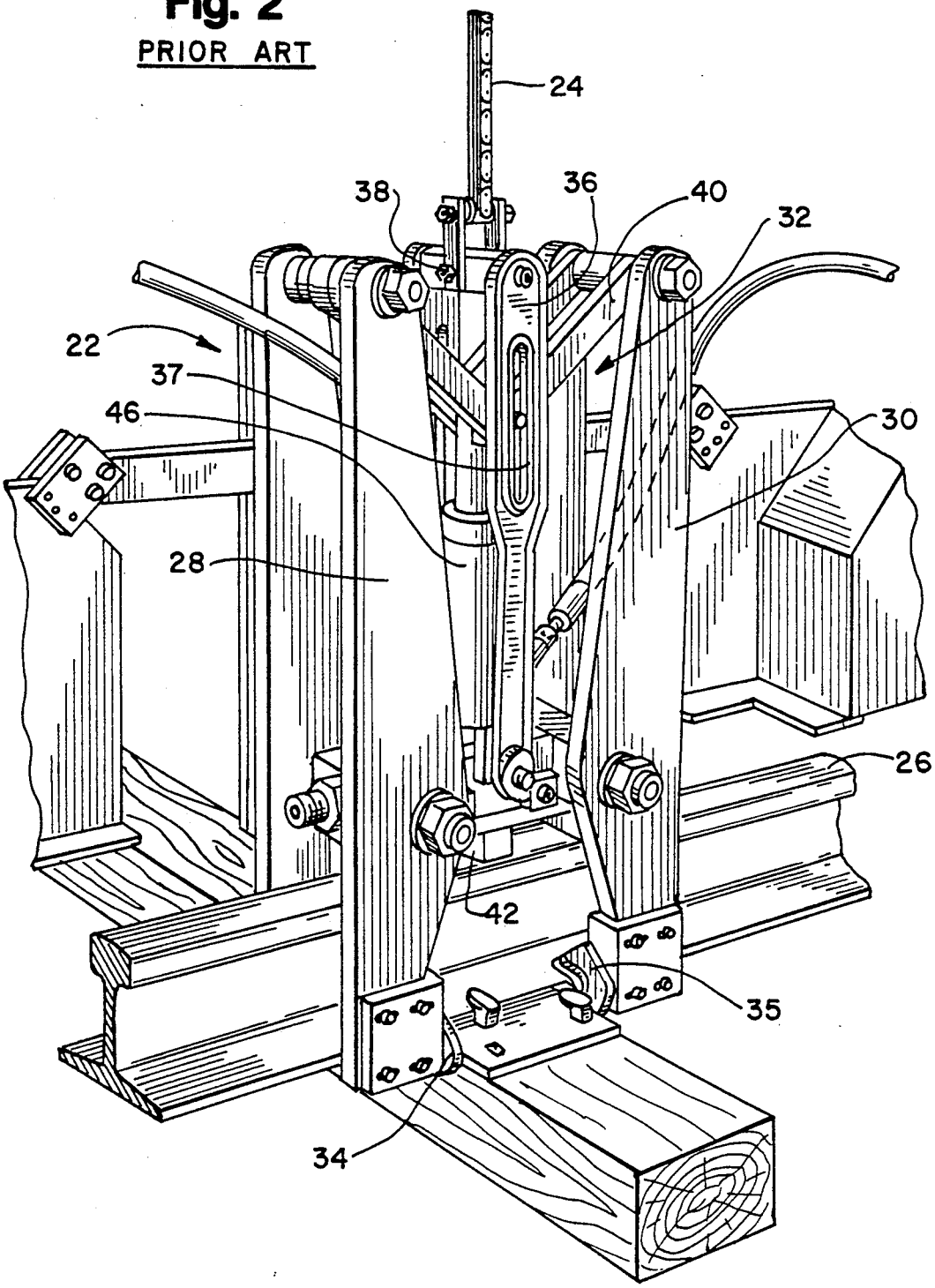
Fig. 2 PRIOR ART
FIG. 2 is a perspective view of a prior art device.

A prior art device is shown in FIG. 2. A relocator assembly 22 is suspended from a chain 24 and is lowered into engagement with a rail 26. A pair of relocator arms 28, 30 are driven by a linkage 32 to move a pair of anchors 34, 35. The linkage 32 comprises a fixed yoke 36 having a vertical slot 37 which guides rotation of a pair of pinned links 38, 40 to rotate the arms 28, 30 about pivot points 42, 44, respectively. The pinned end of the links 38, 40 is driven by a hydraulic actuator 46 which is suspended from the chain 24. This arrangement provides a mechanical advantage for the linkage 32 which results in minimal adjusting force applied to the clamps over a portion of the range of stroke of the actuator. The invention herein provides maximum adjusting force over substantially the entire stroke range.

Figure 3:
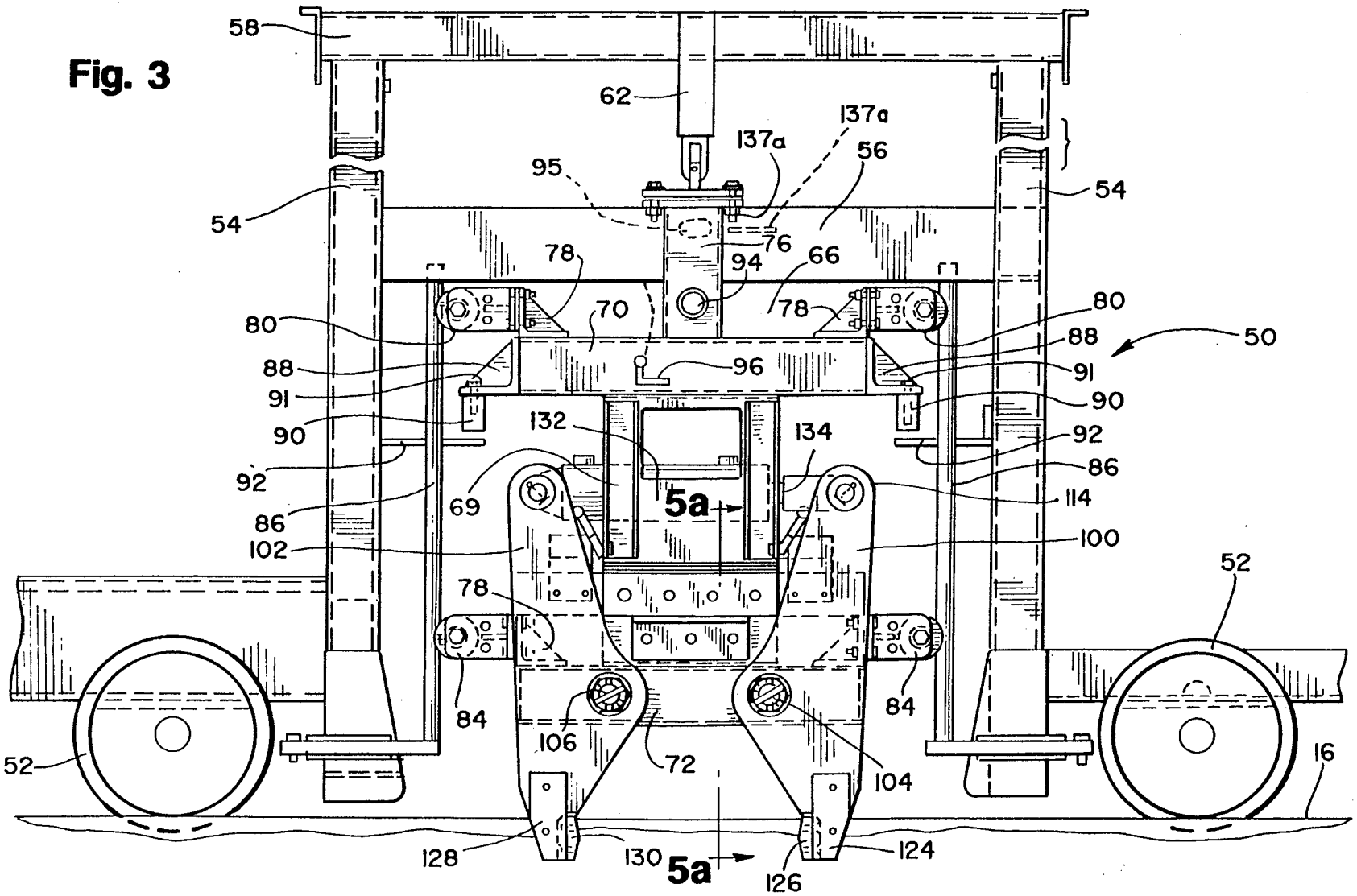
FIG. 3 is a fragmentary side elevational view of a dual head adjuster embodying the present invention.

An anchor adjuster, generally designated 50, according to the invention is shown in FIGS. 3 and 4 and includes a vehicle chassis rotatably mounting rail-engaging wheels 52 for lengthwise positioning of the anchor adjuster along the track. Upright members 54 are provided at the four corners of a generally symmetric frame, with longitudinal members 56, 57 (member 57 not shown) extending between upright members 54 at an intermediate height and longitudinal members 58, 59 extending between the upright members at the top of the frame. Transverse frame members 60, 61 extending across the top of the frame. Longitudinal members 56, 57 each mount a hydraulic head lift cylinders 62, only one head lift cylinder being visible in FIG. 3.

Figure 6:
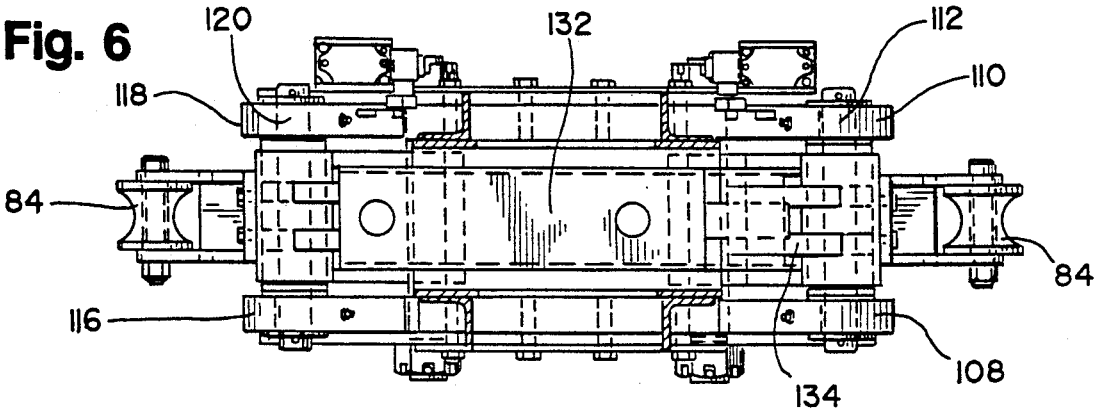
FIG. 6 is a sectional view taken along line AA of FIG. 5.

A pair of head assemblies, shown generally at 66, and with only one head assembly shown in FIG. 3, are movably supported by head lift cylinders 62, respectively, with the head lift cylinders interposed between the frame and the head assembly. Head assembly 66 has a carriage 69 comprising a spaced apart header plate 70 and a footer plate 72 rigidly interconnected to each other by a pair of vertical links 74 and a horizontally extending cross brace structure 75. An elongated tongue 76 extends upwardly from header plate 70 and engages a vertically movable piston rod 63 of hydraulic lift cylinder 62 at a distal end thereof. L-shaped flanges 78 are spaced peripherally about the head assembly and are fixed to centrally positioned carriage 69 by welding or alternative attachment means. Flanges 78 rotatably mount a pair of upper guide rollers 80 at opposite ends of header plate 70 and rotatably mount a pair of lower guide rollers 84 at opposite ends of footer plate 72. Each of guide rollers 80, 84 has a circumferential groove (see FIG. 6) for engaging complementary upwardly extending guide rails 86 which are fixed to the frame for guiding vertical movement of the head assembly between a raised travel position and a lowered operative position.

A pair of vertically depending stop pads 90 are spaced oppositely on header plate 70 and attached thereto by means of end flanges 88 with threaded fasteners 91. L-shaped stops 92 attached to upright members 54 of the frame extend inwardly and engage stop pads 92 to limit the travel of the head assembly when the assembly is lowered into an operative position, or in the event of failure of head lift cylinder 62. Stop pads 90 are interchangeable such that the operative position of the assembly may be predetermined by the mounting of stop pads of varying lengths.

A circular aperture 94 extends through tongue 76 and, together with a corresponding aperture 95 formed in longitudinal member 56, receives a safety locking pin 96 for maintaining the position of the head assembly when the head assembly is in a raised travel position.

An anchor adjusting linkage 98 includes a pair of vertically extending adjuster arms 100 and 102 pivoted to footer plate 72 of carriage 69 at spaced points 104 and 106, respectively. Adjuster arm 100 has a pair of adjacent parallel links 108 and 110 joined by a shaft 112 at an upper arm end 114. Adjusting arm 102 has a pair of adjacent parallel links 116 and 118 joined by a shaft 120 at an upper arm end 122. A lower end 124 of arm 100 carries an interchangeable anchor-adjuster tool 126, and a lower end 128 of arm 102 carries an interchangeable anchor-adjuster tool 130.

Figure 5:
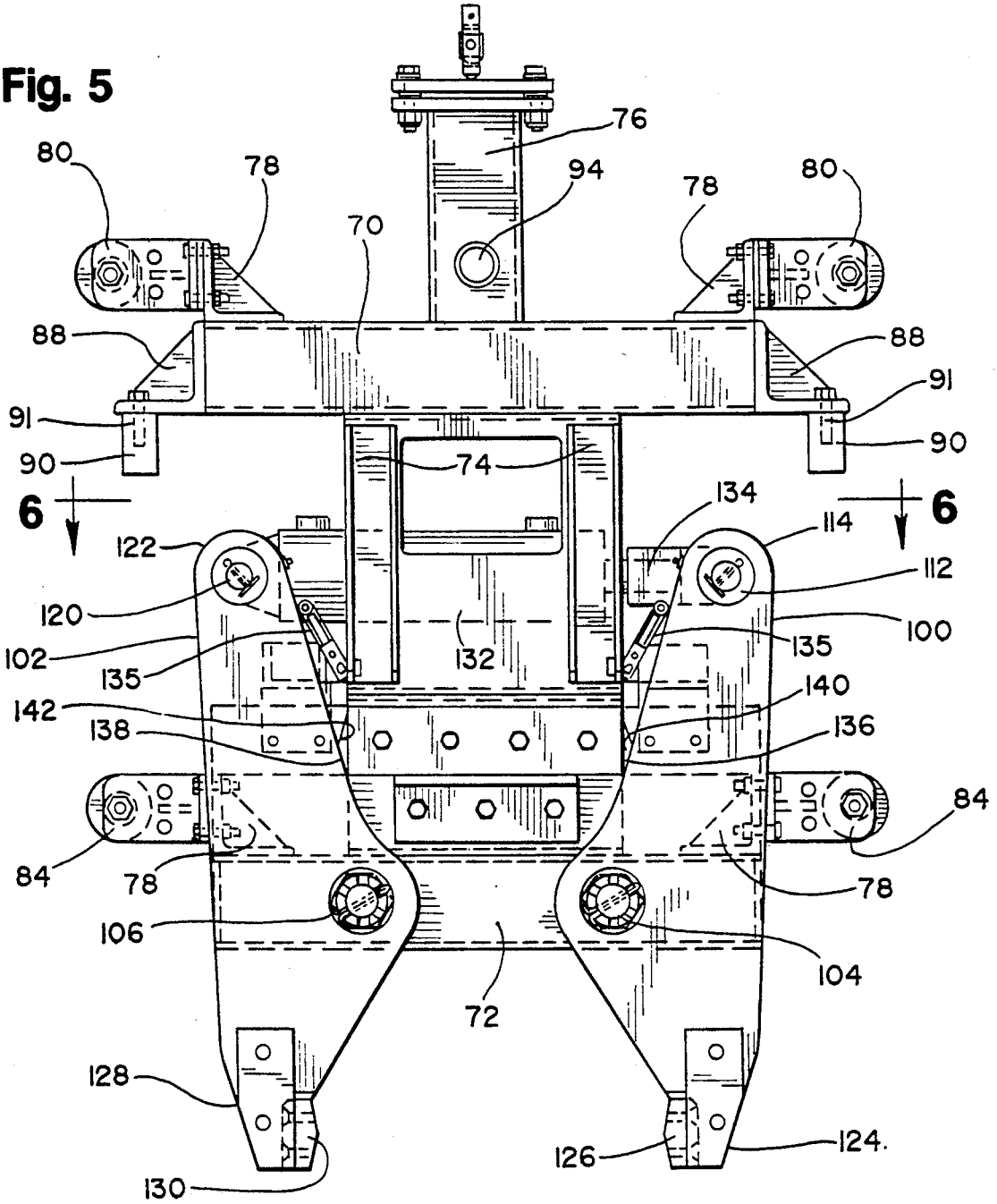
FIG. 5 is a side elevational view of the head assembly shown in FIG. 3.

A hydraulic cylinder 132, having an extendable piston rod 134, rotatably interconnects axles 112 and 120, whereby extension of the piston rod 134 results in a substantially purely horizontal force being applied to the ends 114, 122 of adjuster arms 100, 102, respectively, over the entire range of motion of the piston rod to rotate the arms about pivot points 104, 106, respectively. As shown in FIG. 5, extension of piston rod 134 results in the outward displacement of upper adjuster arm ends 114, 122 and inward displacement of lower adjuster arm ends 124, 128. In this process adjuster tools 126 and 130 are forced towards each other to adjust a pair of rail-mounted anchors. Retraction of cylinder 132 results in the inward displacement of upper adjuster arm ends 114, 122 and outward displacement of lower adjuster arm ends 124, 128. In this process adjuster tools 126 and 130 are moved away from each other to disengage a pair of rail-mounted anchors.

Limit switches 135 are mounted on the header assembly and continuously monitor the angular displacement of the adjuster arms 100, 102. As described below, in the event that the piston rod 134 is not fully retracted prior to raising of the head assembly to an inoperative position, the adjuster arms remain in a rotated position. To prevent damage to the frame, the limit switches detect the condition and through electrical circuit means (not shown) deactivate the head lift cylinder until piston rod 134 is fully retracted.

A limit switch 137 (see FIG. 3) is mounted on a rear side of longitudinal frame member 56 and is operative to detect the position of support bolts 137*a* on tongue 76. By sensing the position of the tongue and therefore the head assembly during the raising and lowering thereof, the requirement of fully retracting cylinder 62 prior to moving the vehicle along the rails to a next tie is obviated. Instead, the head assembly need only be raised to a height sufficient to clear the tie over which the adjuster is instantly positioned. Once the predetermined sufficient height is detected by limit switch 137, electric circuit means (not shown) act to cease retraction of cylinder 28. By eliminating the need to fully retract lift cylinder 62, the adjusting process is significantly expedited.

Figure 5A:
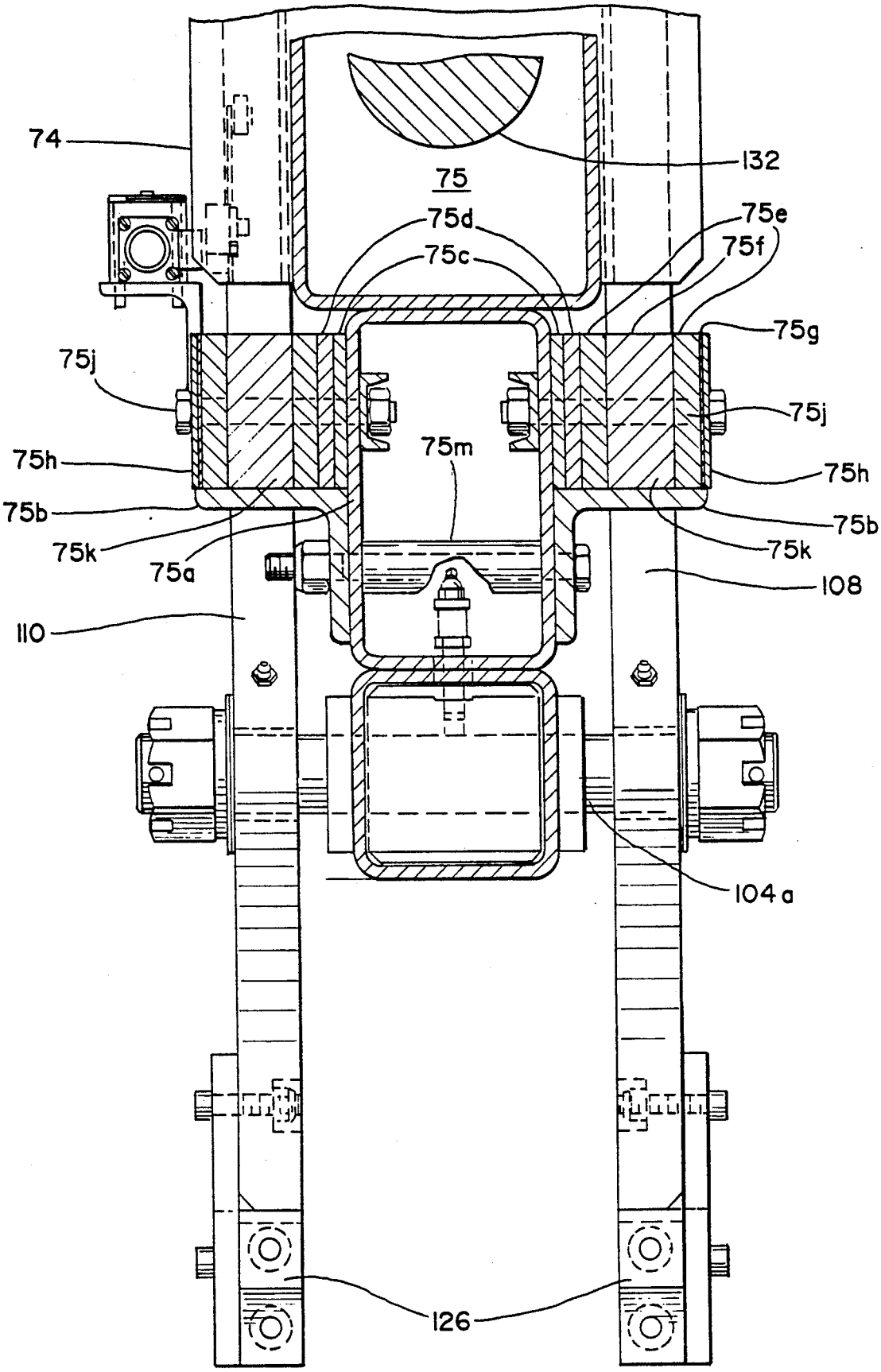
FIG. 5*a* is a sectional view of the head assembly shown in FIG. 3 and taken along line 5—5.

Cross brace structure 75 is shown specifically in FIG. 5*a* and has a generally rectangular tube 75*a* mounting opposite shelf angles 75*b*. A plurality of elongated spacer plates 75*c*, 75*d*, 75*e*, 75*f*, 75*g*, and 75*h* are adjacently sandwiched about tube 75*a* and supported on shelf angles 75*b*. Retaining bolts 75*j* maintain the position of the spacer plates.

Spacer plates 75*f* have a width slightly greater than the width of the adjuster arm links 108,110 and 116,118, such that the adjuster arms 100 and 102 are free to move between guide channels 75*k* formed between opposite spacer plates 75*e*. At the same time, the guide channels 75*k* minimize wobble or out of plane movement of the adjuster arms as they rotate about their respective pivot points. Bolt sleeve 75*m* extends between opposite sides of tube 75*a* and enhances the structural integrity thereof.

Spacer plates 75*c*, 75*d*, 75*e*, 75*g*, and 75*h* are all of different widths and may be interchangeably positioned in a predetermined arrangement on either side of a corresponding adjuster arm link to prescribe the lateral position of the arm links along the pivot shaft 104*a*. Positioning of the adjuster arms results in the placement of the depending applicator tools such that rails of different widths may be accommodated by the anchor adjuster.

As seen in FIG. 5, adjuster arms 100, 102 have inwardly angled surfaces 136, 138, respectively, which may engage tapered end surfaces 140, 142, respectively, on spacer plates 75*f* of cross brace 75 during rotation of the arms.

It is believed the operation of the anchor adjuster will be readily understood from the foregoing description and may be briefly summarized as follows. The anchor adjuster is brought to a desired location along the rails to have the head assemblies overlie a tie, with the adjuster arms 100, 102 symmetrically flanking a pair of previously applied rail-mounted anchors. Safety pin 96 then is removed and head assembly 66 is driven from a raised, stored travel position to a lowered operative position by hydraulic cylinder 62. Hydraulic cylinder 62 deploys the head assembly downwardly along guide rails 86 until stop pads 90 engage the stops 92. In this way, the length of the stop pads prescribes the lower position of the head assembly and therefore limits the downward travel of the assembly. This is a particularly useful adjustment due to variations in the height of rails with which the anchor adjuster is used. Because of the forceful driving of the head assembly by cylinder 62, the fact that the adjuster arm ends 124, 128 may engage densely packed railway ballast is not critical. Hydraulic cylinder 62 is of sufficient power to drive the adjuster arms into the ballast until the stop pads make contact with the stops.

Once head assembly 66 is lowered into an operative position, hydraulic cylinder 132 is activated to extend piston rod 134. Adjuster arms 100, 102 are rotated about pivots 104, 106, respectively, and the lower adjuster arms are brought together. As the arms are rotated, anchor-adjuster tools 126, 130 ar ®brought into contact with a pair of previously rail-mounted anchors and move the anchors into abutting relation with the tie. It can be seen that for a fixed maximum stroke of piston rod 134, the distance between the lower ends of the adjuster arms also is fixed as prescribed by the kinematic relationships of the linkage. In order to accommodate the variations in the width of a rail with which the anchor adjuster is used, the anchor adjuster tools are interchangeable with tools of different width, such that the same actuator stroke will fully abut a pair of rail-mounted anchors with a tie.

Upon completing adjustment of the anchors, piston rod 134 is retracted to rotate the adjuster arms back into a travel position. Head lift cylinder 62 then is actuated to raise the head assembly, and safety pin 96 is reinserted to lock the head position. In the event that piston rod 134 is not fully retracted prior to raising of the head assembly, such that the adjuster arms are still in a rotated position when the head assembly is raised, limit switch 135 detects the condition and through electrical circuit means (not shown) deactivates the head lift cylinder to prevent damage to the assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An anchor adjuster for adjusting one or more rail-mounted anchors on a rail toward a tie, with the rail having a base resting on an upwardly directed surface of the tie whereby an anchor movably mounted on the rail base extends below the upwardly directed tie surface, comprising:

a frame;

a head assembly movably mounted on the frame and having a given weight;

actuator means on the frame for positively driving the head assembly forcibly downward toward a tie with a driving force in addition to gravitational force caused by the given weight of said head assembly; and adjuster means on the head assembly for engaging an anchor and moving said anchor generally horizontally along a rail toward a tie.

2. The anchor adjuster defined in claim 1 in which the frame has a plurality of spaced apart guide members and the head assembly has a centrally positioned carriage moveable on the guide members, the adjuster means including a pair of vertically extending adjuster arms pivoted to the carriage and each having anchor-engaging adjuster tools at the lower end thereof, and a hydraulic cylinder interconnecting the adjuster arms whereby the hydraulic cylinder can pivot the adjuster arms to move the adjuster tools toward the tie to adjust the anchors.

3. The anchor adjuster defined in claim 1 including travel limiting means on the frame for setting a lowered position of the head assembly.

4. The anchor adjuster defined in claim 1 including interchangeable anchor engaging means on adjuster arms of the adjuster means for accommodating variations in the width of rails with which the adjuster means is used.

5. The anchor adjuster defined in claim 1 in which the actuator means comprises a hydraulic cylinder having a substantially vertically movable piston rod interposed between the frame and the head assembly.

6. An anchor adjuster for adjusting one or more rail-mounted anchors on a rail toward a tie at points along the length of the rail, with the rail having a base resting on an upwardly directed surface of the tie whereby an anchor movably mounted on the rail base extends below the upwardly directed tie surface, comprising:

a vehicle movable along a pair of rails and having a frame overlying a portion of the pair of rails;

a head assembly mounted on the frame and movable between a raised inoperative position and a lowered operative position, the head assembly having a given weight;

adjuster means on the head assembly for engaging at least one pair of rail-mounted anchors and moving said anchors generally horizontally along the rail toward each other; and actuator means on the frame for positively driving the head assembly forcibly downward from the inoperative position to the operative position with a driving force in addition to gravitational force caused by the given weight of said head assembly; and safety means for securing the head assembly in said inoperative position independent of said actuator means for safety purposes during travel of the vehicle along the rails.

7. The anchor adjuster defined in claim 6 in which the head assembly includes a vertically moveable carriage, the adjuster means includes a pair of vertically extending adjuster arms pivoted to the carriage and each having anchor-engaging adjuster tools at the lower end thereof, and a horizontally oriented hydraulic cylinder interconnecting the adjuster arms whereby the hydraulic cylinder can pivot the adjuster arms to move the adjuster tools toward the tie to adjust the anchors.

8. The anchor adjuster defined in claim 7, said safety means comprising releasable connection means for interconnecting the frame and the head assembly.

9. The anchor adjuster defined in claim 8 in which the releasable connection means comprises a first aperture on the frame and a second aperture on the head assembly, with the first aperture and the second aperture being in alignment when the head assembly is in its inoperative position, and retention means insertable through the aligned apertures.

10. The anchor adjuster defined in claim 6 wherein the adjuster means comprises a pair of rotary arms movable toward a retracted position in the inoperative position of the head assembly and including limit sensing means for detecting a fully retracted position of the adjuster means prior to moving the head assembly toward the inoperative position.

11. The anchor adjuster defined in claim 6 wherein the adjuster means comprises a pair of rotary arms each having a pair of parallel links for engaging a portion of an anchor extending beyond opposite sides of a rail, with interchangeable spacer means interposed between each pair of parallel links for accommodating rails of different sized widths.

12. The anchor adjuster defined in claim 6 wherein the head assembly is elevated toward the inoperative position prior to moving the vehicle along the rails, and including position sensing means on the frame for detecting a sufficiently elevated position of the head assembly prior to moving the vehicle along the rails.

* * * * *